US005730088A

United States Patent [19]

Foley et al.

[11] Patent Number: 5,730,088

[45] Date of Patent: Mar. 24, 1998

[54] HEAT RECOVERY STEAM GENERATOR

[75] Inventors: Robert J. Foley, Upton; David V. Lesneski, Gardner; William J. Fidurko, Needham; Brian Kassabian, Worcester, all of Mass.

[73] Assignee: DB Riley, Inc., Worcester, Mass.

[21] Appl. No.: 577,501

[22] Filed: Dec. 22, 1995

[51] Int. Cl.[6] ..... F22D 1/00

[52] U.S. Cl. ..... 122/7 R; 122/20 B; 110/234

[58] Field of Search ..... 122/20 B, 7 R, 122/367.1, 367.2, 367.3; 110/234

[56] References Cited

U.S. PATENT DOCUMENTS

| | | | |
|---|---|---|---|
| 674,891 | 5/1901 | Watson . | |
| 2,271,131 | 1/1942 | Price . | |
| 4,244,326 | 1/1981 | Jackson . | |
| 4,351,276 | 9/1982 | Kremer . | |
| 4,470,359 | 9/1984 | Smith | 110/234 |
| 4,485,746 | 12/1984 | Erlandsson | 110/234 |
| 4,627,388 | 12/1986 | Buice | 110/234 |
| 4,745,868 | 5/1988 | Seabury | 110/234 |
| 4,922,839 | 5/1990 | Boucher | 110/234 |
| 5,029,557 | 7/1991 | Korenberg | 110/234 |
| 5,259,342 | 11/1993 | Brady et al. | 110/234 |
| 5,433,174 | 7/1995 | Brady et al. | 110/234 |

*Primary Examiner*—Henry A. Bennett
*Assistant Examiner*—Jiping Lu
*Attorney, Agent, or Firm*—Mason, Kolehmainen, Rathburn and Wyss

[57] ABSTRACT

Heat recovery apparatus for extracting heat from a hot flue gas stream especially useful on a marine vessel. The apparatus includes a housing having opposite outer end walls, opposite outer side walls, a top wall and a bottom wall with a heat exchanger extending between the end walls spaced downwardly below the top wall, above the bottom wall and inwardly of the outer side walls. An inlet chamber is formed in the housing having an inlet opening in one of the end walls above the heat exchanger for receiving the hot flue gas stream and the inlet chamber includes a downwardly sloping wall for directing the incoming hot flue gas stream to flow downwardly through the heat exchanger toward the bottom wall. A pair of inner side walls are provided on opposite sides of the heat exchanger spaced inwardly of the outer side walls for directing the hot flue gas stream downwardly through the heat exchanger to a low level above the bottom wall. The inner side walls and the inlet chamber wall define a pair of up-flow side chambers between the edges of the heat exchanger and facing outer side walls of the housing for directing flue gases upwardly from the low level for collection adjacent the top wall. An outlet opening is provided in the top wall for exhausting flue gas from the side chambers to a stack or other components.

20 Claims, 4 Drawing Sheets

HEAT RECOVERY STEAM GENERATOR

BACKGROUND OF THE INVENTION

1. Field of the Invention

The present invention relates to a new and improved heat recovery steam generator for extracting heat from a hot flue gas stream and more particularly to heat recovery apparatus especially adapted for use on a marine vessel.

The heat recovery steam generator (HRSG) of the present invention is capable of producing superheated steam from the heat extracted from an exhaust flue gas stream from sources such as furnaces, gas turbines, boilers, etc., and functions in a highly efficient manner in recovering heat energy that might otherwise be lost out a stack into a surrounding environment.

2. Background of the Prior Art

Watson U.S. Pat. No. 674,891 discloses an evaporator of sea water to be reduced to fresh water for providing boiler feed water for a steam ship. The evaporator is mounted in the stack of the steam ship and includes a central flue.

Price U.S. Pat. No. 2,271,131 discloses a waste heat boiler for an aircraft utilizing heat from an engine exhaust stack. Hot gas enters the bottom of a casing and passes upwardly around a stack of horizontally extending steam tubes having external fins thereon and eventually passes out an exhaust port aided by suction from an external slip stream around the flying aircraft.

Jackson U.S. Pat. No. 4,244,326 discloses a steam generating system wherein furnace flue gases pass into a closed, insulated heat chamber containing a plurality of separate steam coils fed with water and provided with blowers for circulating hot gases around the coils in a circumferential direction.

Kremer U.S. Pat. No. 4,351,276 discloses a heat recovery device for boilers located in stack gas stream with a pot-shaped vessel having a gas inlet on one side and one or more gas outlets on an opposite and adjacent side. A vertical wall is provided inside the vessel between the gas inlet and gas outlets forming an internal chamber containing U-shaped tubes depending downwardly from plenum chambers on the upper end of the vessel.

OBJECTS OF THE INVENTION

It is an object of the present invention to provide a new and improved heat recovery steam generator having a low level center of gravity and a small size floor plan or footprint yet having a high recovery capacity and a capability of generating superheated steam.

Yet another object of the present invention is to provide a new and improved heat recovery steam generator especially well suited for use on a marine vessel.

Still another object of the present invention is to provide a new and improved heat recovery steam generator having a central down-flow of gas through a heat exchanger and an up-flow of gas around opposite sides of the heat exchanger, thus minimizing insulation requirements.

BRIEF SUMMARY OF THE PRESENT INVENTION

The foregoing and other objects and advantages of the present invention are accomplished in a new and improved heat recovery apparatus for extracting heat from a hot gas stream. The apparatus includes a housing having opposite outer end walls, opposite outer side walls, a top wall and a bottom wall. A heat exchanger is contained within the housing extending between the end walls and is spaced downwardly of the top wall, above the bottom wall and inwardly of the opposite side walls. An inlet chamber is formed in the housing having an inlet opening in one of the end walls above the heat exchanger for receiving the hot flue gas stream. The inlet chamber has a wall sloping downwardly for directing the hot flue gas stream to flow downwardly through the heat exchanger toward the bottom wall. Inner side walls are provided on opposite sides of the heat exchanger spaced apart inwardly of the outer side walls for directing the hot flue gas stream downwardly through the heat exchanger to a low level spaced above the bottom wall. The inner side walls and the inlet chamber walls define a pair of up-flow side chambers between the heat exchanger and the outer side walls for containing an upward flow of the flue gas from the low level toward the top wall and an outlet opening is provided in the top wall for exhausting gas from the side chambers.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT OF THE INVENTION

Figure 2:
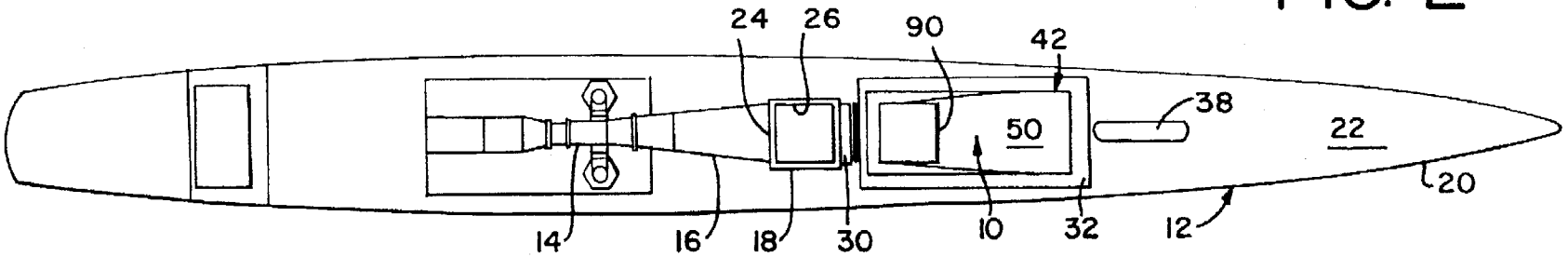
FIG. 2 is a top plan view of the vessel.
Figure 1:
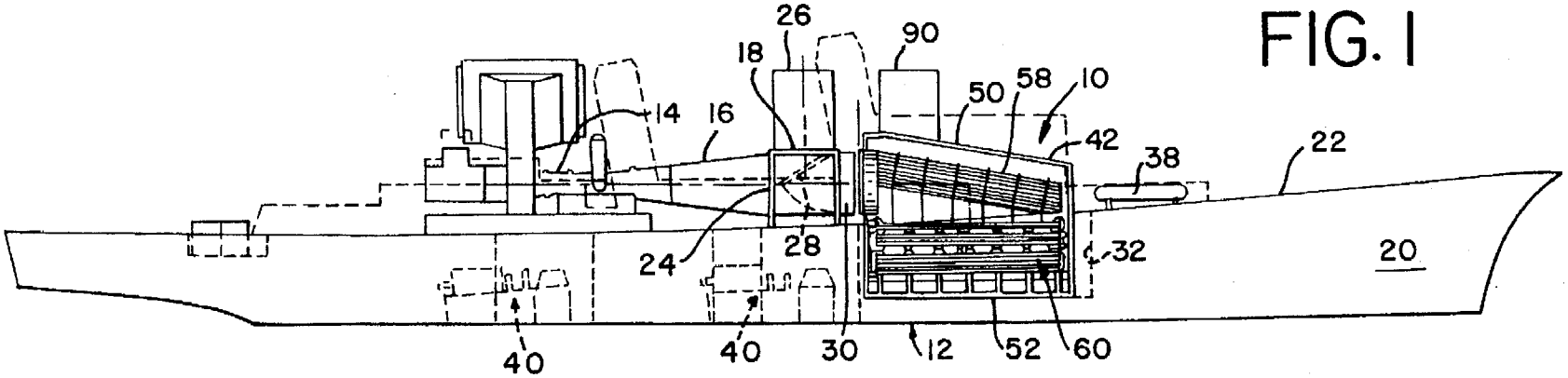
FIG. 1 is a side elevational view of a marine vessel having a heat recovery steam generator in accordance with the features of the present invention.

Referring now more particularly to the drawing, therein is illustrated a new and improved heat recovery steam generator (HRSG) constructed in accordance with the features of the present invention and referred to generally by the numeral 10. The HRSG 10 is especially well suited for use on a marine vessel 12 having a gas turbine 14 or boiler producing a quantity of high temperature exhaust or flue gas which is directed into the HRSG 10 via an enlarging diffuser 16 or a bypass 18. The vessel 12 includes a hull 20 and a deck 22 and an upper portion of the HRSG 10 extends above the deck while a lower and heavier portion extends well below the deck into the interior of the hull thus providing a low center of gravity for the HRSG and hull combination with resultant excellent marine stability characteristics.

Figure 3:
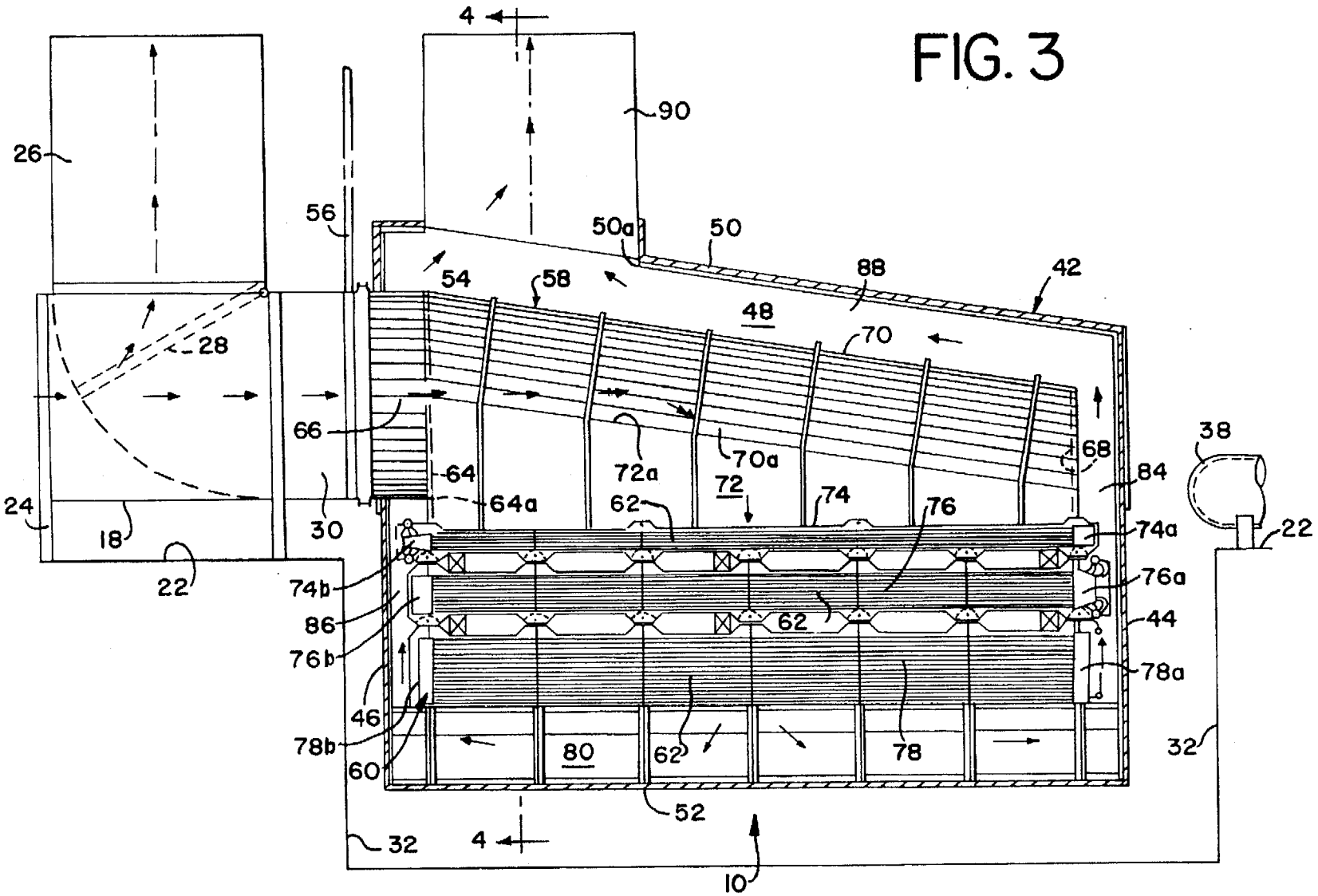
FIG. 3 is an enlarged side elevational view of the heat recovery steam generator.

The diverter 18 includes a generally rectangular-shaped, box-like housing 24 (FIG. 3) having an inlet on an aft end wall for receiving a hot flue gas stream from the turbine 14 and the diffuser 16 and an outlet in a top wall for discharging some or all of the hot flue gas to a by-pass stack 26 mounted on top of the housing. Some or all of the hot flue gas received can be by-passed to the stack 26 by means of a diverter damper panel 28 which is pivotally mounted in the housing 24 to move between a horizontal position for directing all of the hot flue gas flow into the HRSG 10 or a vertical position for directing all of the hot flue gas into the by-pass stack. The diverter damper panel 28 can be set in a selected intermediate angular position (dotted lines—FIG. 3) between the vertical and the horizontal to apportion the hot gas stream as desired between the HRSG 10 and the by-pass stack 26. The diverter housing 24 has an outlet on a forward end wall for discharging hot flue gas to the HRSG via a connecting duct 30.

Figure 4:
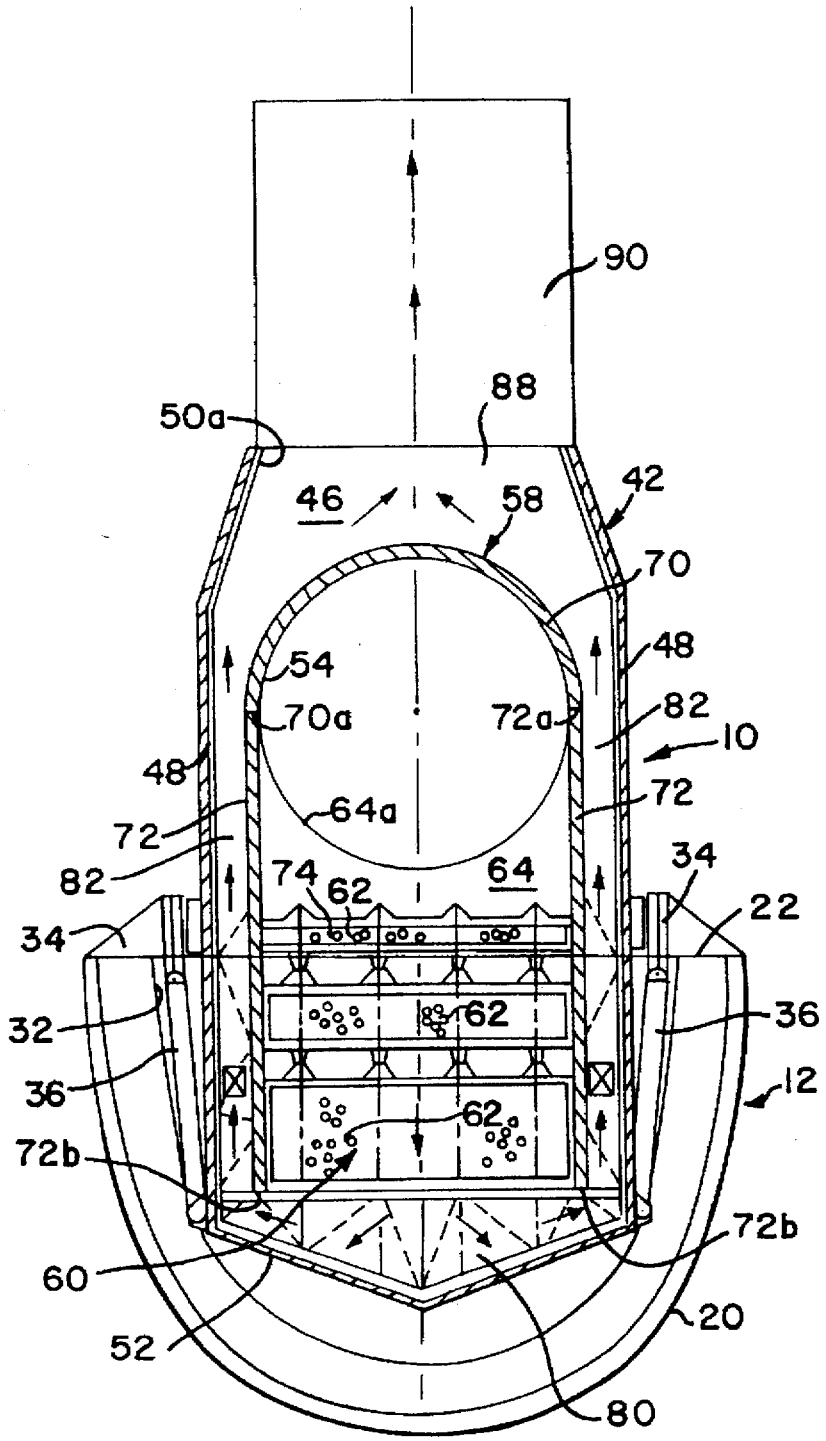
FIG. 4 is a transverse cross-sectional view of the vessel and heat recovery steam generator taken substantially along lines 4—4 of FIG. 3.

In accordance with the present invention, the HRSG 10 is mounted in a well 32 formed in the deck 22 of the vessel 12 and is supported at a plurality of longitudinal spaced web truss sections on the hull 20 from bulkheads 34 on opposite sides (FIG. 4) by means of arms 36 extending downwardly therefrom and attached at lower ends to opposite sides of the HRSG. Ahead or forward of the well 32, a high pressure steam drum 38 is provided to hold/purify the steam generated in the HRSG 10 and provide a source of high pressure steam for supplying steam to be superheated for land or marine use.

The HRSG 10 includes a housing 42 having fore and aft opposite outer end walls 44 and 46, a pair of opposite outer side walls 48, a top wall 50 and a V-shaped bottom wall 52. The aft outer end wall 46 is formed with an inlet opening 54 above the level of the deck 22 for receiving a stream of hot flue gas from the connector duct 30. An isolation damper 56 is positioned outside of the inlet opening 54 for cutting off the incoming flow of hot flue gas in the event of an emergency.

The inlet opening 54 in the aft outer end wall 46 is in direct communication with an inlet chamber 58 formed in an upper portion of the housing 42 spaced below the top wall 50 and above the level of a multiple bank heat exchanger 60 having banks of water/steam tubes 62 extending longitudinally between the opposite inner end walls 64 and 68. The inlet chamber 58 includes an aft inner end wall 64 spaced forwardly of the outer housing aft end wall 46 and the inner end wall is formed with a circular opening **64*a* at the upper end aligned with the inlet opening 54 and connected thereto by a short cylindrical inlet duct 66. The inlet chamber 58 also includes a forward inner end wall 68 spaced rearwardly of the outer housing forward end wall 44**.

The inlet chamber 58 includes a semicylindrical upper wall 70 which slopes downwardly from the inlet opening **64*a* toward the forward inner end wall 68 thus decreasing the cross-sectional flow area of the inlet chamber progressing forwardly in the HRSG 10. Lower opposite edges 70*a* of the upper wall 70 are joined with upper edges 72*a* of a pair of vertically extending inner side walls 72 spaced inwardly of the outer opposite outer side walls 48 on opposite sides of the heat exchanger 60. The inner chamber 58 is designed to direct the incoming hot flue gas stream downwardly through the banks of water/steam tubes 62 of the heat exchanger as indicated by the arrows in FIG. 3 and the decreasing flow cross-section provides for an even distribution of the hot gas over the entire horizontal area of the heat exchanger 60**.

Preferably, the heat exchanger 60 has an upper level tube bank 74 which functions as a high pressure superheater and is in contact with the flue gas flow at the highest temperature. An intermediate level tube bank comprising a high pressure evaporator 76 is spaced below the superheater 74 and the downwardly flowing hot flue gas reaching the evaporator is reduced in temperature because of the heat given up to the superheater. A high pressure economizer 78 is spaced below the evaporator 76 above the bottom wall 52 and the hot flue gas reaching the economizer is at a lower temperature than that reaching the evaporator because of the heat given up in superheater 74 and the evaporator 76.

The inner side walls 72 have a lower edge **72*b* just below or adjacent the lowest economizer tubes 62 of the heat exchanger 60 to contain the flow of hot flue gas in a downward direction until reaching a low level at the bottom of the heat exchanger economizer tube bank 78. A space 80 is provided below the level of the lower edges 72*b* of the inner side walls 72 above the bottom wall 52 forming a lower plenum chamber directly below the heat exchanger 60. The upwardly sloping halves of the bottom wall 52 direct the flue gas upwardly and outwardly toward opposite sides of the heat exchanger 60 to flow upwardly through side chambers 82 formed between adjacent pairs of inner side walls 72 and outer side walls 48. End chambers 84 and 86 are formed between forward inner end wall 68 and forward outer end wall 44, and between aft inner end wall 64 and aft outer end wall 46. These end chambers 84 and 86 contain an upwardly directed flow of flue gas outside of the heat exchanger 60 as do the side chambers 82**.

Opposite ends of the respective tube banks 74, 76 and 78 of the heat exchanger 60 are interconnected with header systems **74*a*, 74*b*, 76*a*, 76*b*, 78*a* and 78*b* respectively, for directing the flow of steam and/or water into and out of the tubes 62. The header systems are supported on the fore and aft inner end walls 68 and 64**.

Because the upwardly flowing flue gas in the side chambers 82 and the fore and aft end chambers 84 and 86 as well as the gas in the lower plenum chamber 80 is at a temperature much lower than the incoming flue gas flow through the inlet opening **64*a*, the need to insulate the walls of the housing 42 of the HRSG 10 is minimized, especially because the lowest temperatures are on the inside of the outside walls of the housing. Moreover, the chambers 80, 82, 84 and 86 serve as insulation for the inner mounted heat exchanger 60** so that more efficient high temperature operation can take place.

An upper plenum chamber 88 between the housing top wall 50 and the upper wall 70 above the inlet chamber 58 collects the upward flow of flue gas from the chambers 82, 84 and 86, and the top wall is formed with an outlet opening **50*a* directing the flue gas into an exhaust stack 90. The unique positioning of the highest temperature portion of the HRSG 10 at the center surrounded by cooler chambers 80, 82, 84, 86 and 88** on the outside results in a very small footprint or floor area yet an extremely high performance operation ideally suited for marine vessels where space is always at a premium.

Figure 5:
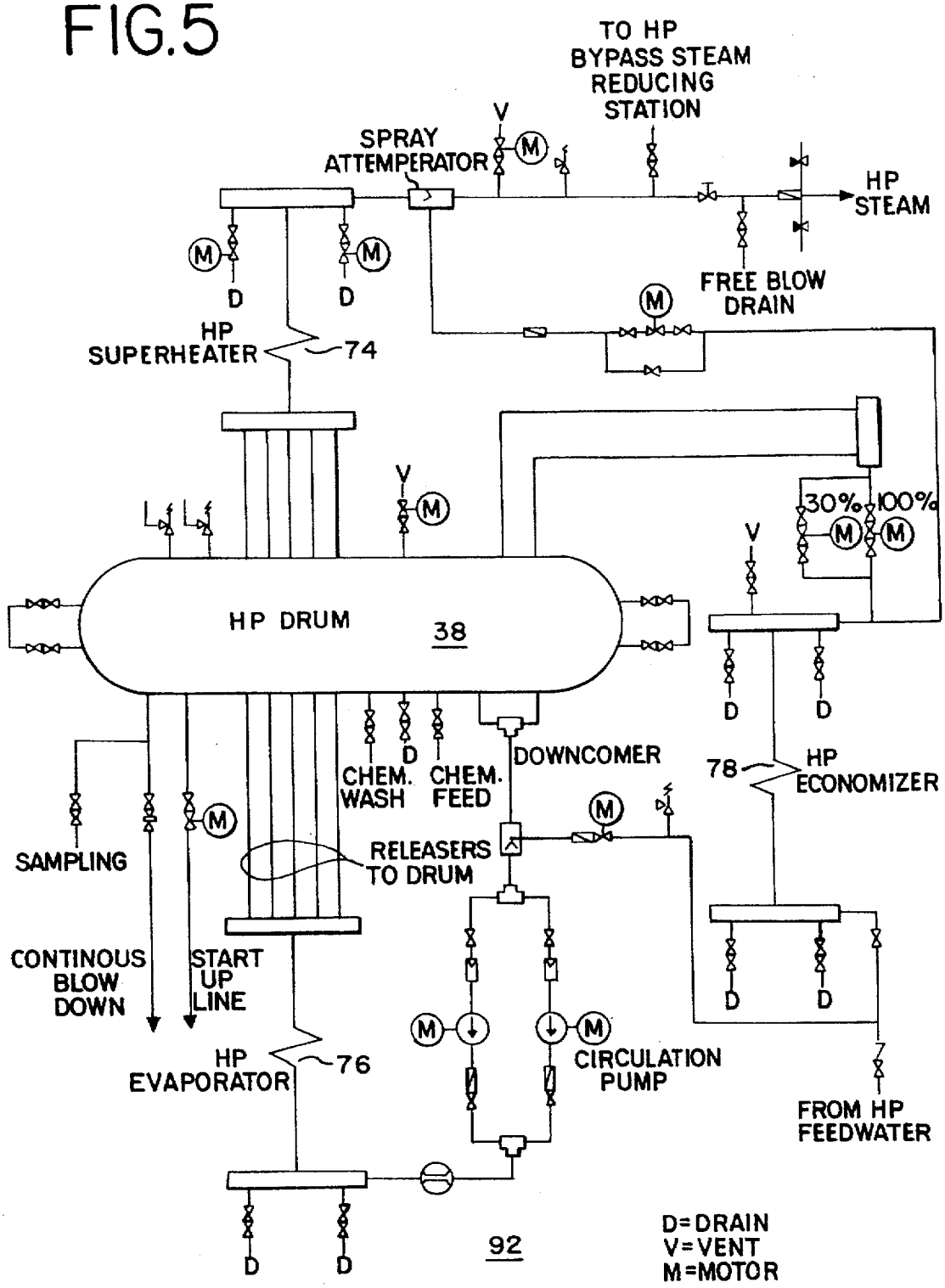
FIG. 5 is a schematic diagram illustrating the fluid flow paths and equipment components of the heat recovery steam generator.

FIG. 5 illustrates a typical piping and component system 92 which is associated with the HRSG 10 to collect and store generated steam in a high pressure condition in a drum 38 interconnected with the high pressure superheater 74, the high pressure evaporator 76 and the high pressure economizer 78.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. Heat recovery apparatus for extracting heat from a hot flue gas stream, comprising:

housing means having end walls, side walls, a top wall and a bottom wall;

heat exchanger means extending between said end walls spaced downwardly of said top wall, above said bottom wall and inwardly of said side walls:

a bottomless inlet chamber in said housing means, said inlet chamber having an inner end wall having an inlet opening connected by duct means to an inlet opening in one of said end walls of said housing means above said heat exchanger means receiving the hot flue gas stream and said inlet chamber having an upper wall means for directing said hot flue gas stream to flow downwardly through said heat exchanger means toward said bottom wall;

inner side walls connected to said inlet chamber upper wall means and extending on opposite sides of said heat exchanger means spaced apart inwardly of said side walls and spaced upwardly of said bottom wall of said housing means and below said heat exchanger means for directing said hot flue gas stream downwardly to a low level below said heat exchanger means;

said inner side walls and said inlet chamber upper wall defining a pair of side chambers between said heat exchanger means and said side walls of said housing means for containing an upward flow of said flue gas from said low level toward said top wall; and an outlet opening in said top wall for exhausting flue gas from said side chambers.

2. The heat recovery apparatus of claim 1, wherein:

said inlet chamber wall means includes an inner end wall opposite said inlet opening spaced inwardly of the other of said end walls defining an end chamber for directing gas from said heat exchanger means toward said top wall outside of said inlet chamber.

3. The heat recovery apparatus of claim 1, wherein:

said wall means of said inlet chamber includes an upper portion is spaced below said top wall forming a top chamber for directing flue gas toward said outlet opening.

4. The heat recovery apparatus of claim 3, wherein:

said upper portion of said wall means of said inlet chamber slopes downwardly from said inlet opening toward said inner end wall.

5. The heat recovery apparatus of claim 1, wherein:

said inlet chamber is reduced in flow cross-section from said inlet opening toward said inner end wall.

6. The heat recovery apparatus of claim 1, wherein:

said heat exchanger means includes opposite ends spaced inwardly of said end walls of said housing means defining upward flow paths for said flue gas adjacent said housing end walls from said low level toward said top wall.

7. The heat recovery apparatus of claim 6, wherein:

said heat exchanger means includes a plurality of spaced apart, parallel, elongated water/steam tubes extending between said opposite ends thereof.

8. The heat recovery apparatus of claim 7, including:

header means at said opposite ends of said water/steam tubes for directing water and steam into and out of said heat exchanger means.

9. The heat recovery apparatus of claim 8, wherein:

said heat exchanger means includes a plurality of spaced apart banks of said elongated water/steam tubes at different levels.

10. The heat recovery apparatus of claim 9, wherein:

one of said banks of elongated tubes is at a highest level of said heat exchanger means directly below said inlet chamber and comprises a superheater.

11. Heat recovery apparatus for a marine vessel of the type having an elongated hull with a deck at an upper edge and powered by a gas turbine, said heat recovery apparatus comprising:

housing means extending above and below said deck into said hull, said housing means including fore and aft opposite outer end walls, opposite outer side joining said end walls, a top wall above deck and a bottom wall below deck;

heat exchanger means extending between said end walls spaced downwardly of said sloping wall, above said bottom wall and spaced inwardly of said outer side and end walls;

a bottomless inlet chamber formed in said housing means, said inlet chamber having an inner end wall having an inlet opening connected by duct means to an inlet opening above deck in one of said end walls of said housing means for receiving hot exhaust/flue gas from the turbine of the vessel, said inlet chamber including a downwardly sloping upper wall below said top wall for directing exhaust/flue gas downwardly through said heat exchanger means toward said bottom wall;

inner side walls connected to said inlet chamber upper wall and extending on opposite sides of said heat exchanger means spaced inwardly of said opposite outer side walls and spaced upwardly of said bottom wall of said housing means and below said heat exchanger means for directing said hot flue gas downwardly to a low level below said heat exchanger means, said inner side wall and said inlet chamber upper wall defining a pair of opposite side chambers between said heat exchanger means and said side walls of said housing means for directing said flue gas upwardly from said low level toward said top wall; and an outlet opening in said top wall for exhausting said flue gas from said side chambers.

12. The heat recovery apparatus of claim 11, wherein:

said inlet chamber wall includes an inner end wall opposite said inlet opening spaced inwardly of the other of said end walls defining an end chamber for directing flue gas from said heat exchanger means toward said top wall outside of said inlet chamber.

13. The heat recovery apparatus of claim 11, wherein:

said wall of said inlet chamber includes an upper portion spaced below said top wall forming a top plenum chamber for directing flue gas toward said outlet opening.

14. The heat recovery apparatus of claim 13, wherein:

said upper portion of said wall means of said inlet chamber slopes downwardly from said inlet opening toward said inner end wall.

15. The heat recovery apparatus of claim 13, wherein:

said top plenum chamber slopes upwardly from an end wall of said housing means remote from said outlet opening.

16. The heat recovery apparatus of claim 11, wherein:

said inlet chamber is reduced in flow cross-section from said inlet opening toward an opposite inner end wall.

17. The heat recovery apparatus of claim 11, wherein:

said heat exchanger means includes opposite ends spaced inwardly of said end walls of said housing means defining upward flow paths for said flue gas adjacent said housing end walls from said low level toward said top wall.

18. The heat recovery apparatus of claim 17, wherein:

said heat exchanger means includes a plurality of spaced apart, parallel, elongated water/steam tubes extending between said opposite ends thereof.

19. The heat recovery apparatus of claim 17, including:

upper and lower plenum chambers above said inlet chamber and below said heat exchanger means, respectively, in communication with upper and lower ends of said side chambers and said end chambers.

20. The heat recovery apparatus of claim 19, wherein:

said lower plenum chamber includes said bottom wall having wall sections on opposite sides sloping up from a center toward said side chambers for directing said flue gas outwardly and upwardly.

* * * * *